US010229774B2

(12) United States Patent
Durth

(10) Patent No.: US 10,229,774 B2
(45) Date of Patent: Mar. 12, 2019

(54) VARISTOR WITH AN ISOLATING ARRESTER

(71) Applicant: PHOENIX CONTACT GMBH & CO. KG, Blomberg (DE)

(72) Inventor: Rainer Durth, Horn-Bad Meinberg (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 15/739,279

(22) PCT Filed: Jul. 13, 2016

(86) PCT No.: PCT/EP2016/066580
§ 371 (c)(1),
(2) Date: Dec. 22, 2017

(87) PCT Pub. No.: WO2017/009355
PCT Pub. Date: Jan. 19, 2017

(65) Prior Publication Data

US 2018/0190414 A1 Jul. 5, 2018

(30) Foreign Application Priority Data

Jul. 13, 2015 (DE) ..... 10 2015 213 050

(51) Int. Cl.
*H01C 7/12* (2006.01)
*H01H 37/76* (2006.01)
(Continued)

(52) U.S. Cl.
CPC ..... *H01C 7/126* (2013.01); *H01H 37/76* (2013.01); *H01H 71/08* (2013.01); *H01T 1/14* (2013.01); *H01H 2235/01* (2013.01)

(58) Field of Classification Search
CPC .... H01C 7/126; H01H 37/76; H01H 2235/01; H01H 71/08
(Continued)

(56) References Cited

U.S. PATENT DOCUMENTS

2001/0055187 A1 12/2001 McLoughlin et al.
2015/0171622 A1* 6/2015 Lee ..... H01C 7/126 361/93.7

FOREIGN PATENT DOCUMENTS

DE 102009004318 12/2009
DE 102013006052 * 8/2014 ..... H01C 7/126
(Continued)

OTHER PUBLICATIONS

English Translation of the Written Opinion for International (PCT) Patent Application No. PCT/EP2016/066580, dated Dec. 8, 2016, 7 pages.
(Continued)

*Primary Examiner* — Kyung S Lee
*Assistant Examiner* — Iman Malakooti
(74) *Attorney, Agent, or Firm* — Sheridan Ross P.C.

(57) ABSTRACT

The subject matter of the invention concerns a varistor with an isolating arrester, wherein the isolating arrester can interrupt the flow of current through the varistor in the event of a fault, wherein the isolating arrester has a terminal contact that establishes an electrical contact to a first contact of the varistor, wherein the electrical contact is protected by a thermally softenable holding device, wherein the isolating arrester also has a detachment means which is biased by means of an energy accumulator and which, in the event of a fault, if the thermally softenable holding device softens, mechanically disconnects the terminal contact from the first contact of the varistor, and wherein the detachment means is
(Continued)

embodied so as to be resistive in order to limit the current through the varistor and prevent electrical arcs.

12 Claims, 3 Drawing Sheets

(51) Int. Cl.
*H01T 1/14* (2006.01)
*H01H 71/08* (2006.01)

(58) Field of Classification Search
USPC ..... 338/21
See application file for complete search history.

(56) References Cited

FOREIGN PATENT DOCUMENTS

| | | | | |
|---|---|---|---|---|
| DE | 112010005119 | | 3/2015 | |
| EP | 1077452 | | 2/2001 | |
| EP | 2284857 | | 2/2011 | |
| JP | H02-267902 | | 11/1990 | |
| JP | H09-134809 | | 5/1997 | |
| JP | H09134809 | * | 5/1997 | ..... H01C 7/12 |
| JP | WO2007142152 | * | 12/2007 | ..... H01C 7/102 |
| WO | WO 2013/034769 | | 3/2013 | |

OTHER PUBLICATIONS

English Translation of the International Preliminary Report on Patentability for International (PCT) Patent Application No. PCT/EP2016/066580, dated Jan. 25, 2018, 9 pages.

Official Action for German Patent Application No. 102015213050.9, dated Jun. 17, 2016, 5 pages.

International Search Report prepared by the European Patent Office dated Oct. 21, 2016, for International Application No. PCT/EP2016/066580.

* cited by examiner

VARISTOR WITH AN ISOLATING ARRESTER

CROSS REFERENCE TO RELATED APPLICATIONS

This application is a national stage application under 35 U.S.C. 371 and claims the benefit of PCT Application No. PCT/EP2016/066580 having an international filing date of 13 Jul. 2016, which designated the United States, which PCT application claimed the benefit of German Patent Application No. 10 2015 213 050.9 filed 13 Jul. 2015, the disclosure of each of which are incorporated herein by reference.

The invention relates to a varistor with an isolating arrester.

It is known from the prior art that overvoltage arresters, and particularly varistors, are subject to non-negligible aging (also known as degradation) due to high energy inputs. It can be observed that various factors have an impact on aging. In particular, however, prevailing environmental conditions as well as the number, frequency, and strength of energy inputs have an impact on aging. With increased aging, leakage currents occur, for example, which result in the (continuous) heating of the overvoltage arrester.

In order to protect the overvoltage arrester and surrounding devices, thermal isolating arresters are therefore often used in which the overvoltage arrester is electrically contacted by means of a spring system, with the spring system being soldered to the overvoltage arrester using a thermally softenable solder or adhesive. Now if impermissible heating occurs, the solder or the adhesive softens, so that the energy stored in the spring system breaks the direct electrical contact to the overvoltage arrester.

However, there are fault conditions in which a strong current flow (fault current or leakage current) has already begun. In these cases—particularly in direct-current networks (DC networks)—it becomes very difficult to interrupt an electric arc that occurs on disconnection and to thus cut off the current flow. Due to the formation of a plasma, electric arcs have very low conductivity. In such cases, either a hazardous (uncontrolled) destruction of the overvoltage arrester occurs or an upstream fuse is tripped, so that now not only the overvoltage arrester but also the actual devices to be protected are disconnected from the network. This results in non-negligible and costly downtime.

A great number of devices are therefore known from the prior art that resolve the extinction of the electric arc through the insertion of insulating protective elements. The intention here is to produce an increased insulated section in order to inhibit the formation and effects of electric arcs at the (disconnecting) contact point.

One substantial drawback of this system is that the sudden interruption of the already-flowing leakage current leads to a pronounced rise in the voltage at the contact point itself. As a result, a high burden is placed on the insulation of the system, which can cause flashovers and, in turn, failure of the entire system. The cause of this is the magnetic energy that is stored at the moment of disconnection by the current that is already flowing on the electrical network. This energy stored in the input leads must inevitably be released. Therefore, the more quickly the current is interrupted, the more pronounced the increase in voltage at the point of separation.

The demands placed on these devices are therefore extremely high, so they can be designed only through the investment of great time and effort and are also costly in terms of materials and manufacturing. Moreover, it should be noted that previous devices have resulted in a substantial enlargement of construction volumes, whereas the market demands increasing miniaturization.

It is therefore the object of the invention to provide an improved and cost-effective varistor with an isolating arrester that avoids one or more of the drawbacks of the prior art.

The object is achieved according to the invention by the features of the independent claim. Advantageous embodiments of the invention are indicated in the subclaims and/or described in the description.

In the following, the invention is explained in further detail with reference to the enclosed drawing on the basis of preferred embodiments.

In the following, reference is made to the figures, with same reference symbols standing for same elements, so that elements that have been described in connection with one figure are not necessarily described again.

Figure 1:
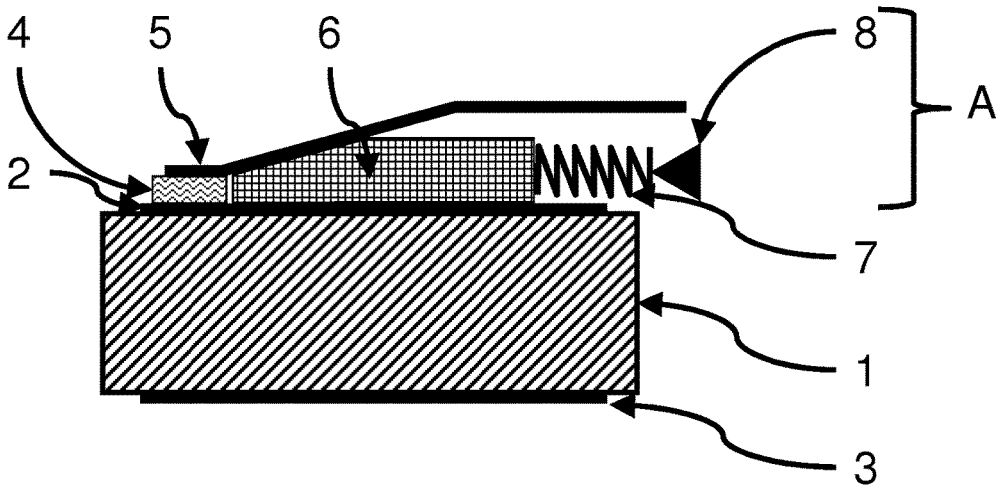
FIG. 1 shows a schematic sectional representation of a first embodiment of the invention.
Figure 2:
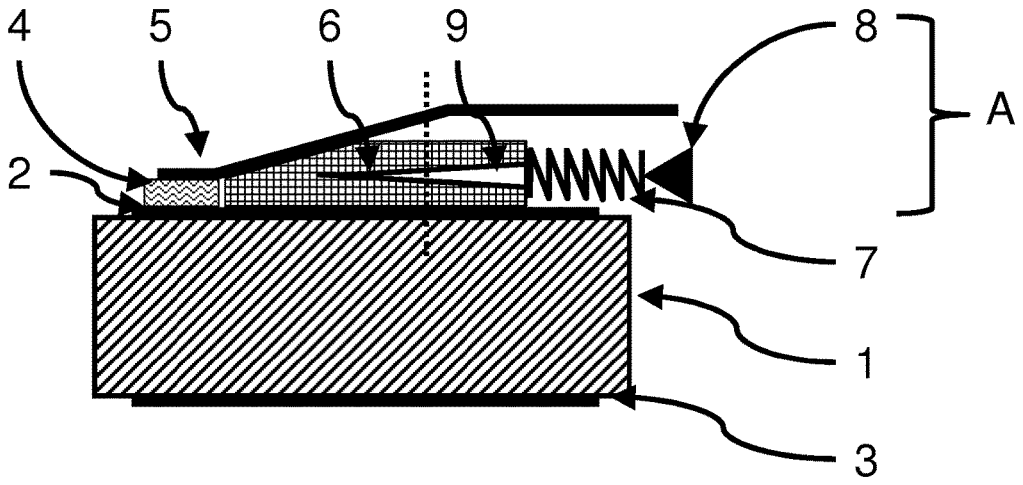
FIG. 2 shows a schematic sectional representation of a second embodiment of the invention.

The figures show a varistor 1 with an isolating arrester A. The varistor has at least one first contact 2 and a second contact 3.

The isolating arrester A is configured such that it can interrupt the flow of current through the varistor 1 in the event of a fault. The term fault is to be understood in a general sense and can include thermal overloading both as a result of leakage currents and as a result of fault currents.

For this purpose, the isolating arrester A has a terminal contact 5. The terminal contact 5 establishes an electrical contact to a first contact 2 of the varistor 1.

The electrical contact is protected by a thermally softenable holding device 4, so that the terminal contact 5 remains connected in an electrically conductive manner to the first contact 2 of the varistor during normal operation.

Moreover, the isolating arrester A also has a detachment means 6 that is biased by means of an energy accumulator 7 during normal operation. For example, an energy accumulator contact face 8 can be provided on the varistor 1 or on a housing (not shown) around the varistor and/or the energy accumulator or another element of the isolating arrester A.

In the event of a fault, the varistor 1 and/or the holding device 4 and/or other components in the thermal vicinity will heat up, whereby the thermally softenable holding device is heated indirectly or directly to the point that the thermally softenable holding device 4 softens. Then the terminal contact 5 is mechanically disconnected by means of the energy accumulator 7 from the first contact 2 of the varistor 1 with the aid of the detachment means 6.

In order to prevent electric arcs to the greatest possible extent, however, the isolating arrester/detachment means 6 is resistive. As a result, current that is still flowing is impeded by the varistor 1 to harmless levels while simultaneously preventing the formation of electric arcs.

This can be achieved in an especially simple manner if the detachment means 6 achieves the disconnection through mechanical interpositioning between the first contact 2 and the terminal contact 5 and then a mechanical and/or, optionally, also electrical contact with the first contact 2 and/or the terminal contact 5 remains without interruption.

In an advantageous embodiment, the external shape of the detachment means 6 is wedge-like at least in sections, thus making insertion (and possible disconnection) especially simple.

Without limiting generality, different materials can be used for the disconnecting means. It is especially simple and cost-effective, however, and enables good electrical and mechanical characteristics to be achieved if plastic and/or ceramic materials are used. The materials themselves can have an appropriate electrical conductivity, or such conductivity can be imparted through filling with electrically conductive substances and—alternatively or in addition—by being provided with an electrically conductive surface.

Figure 3:
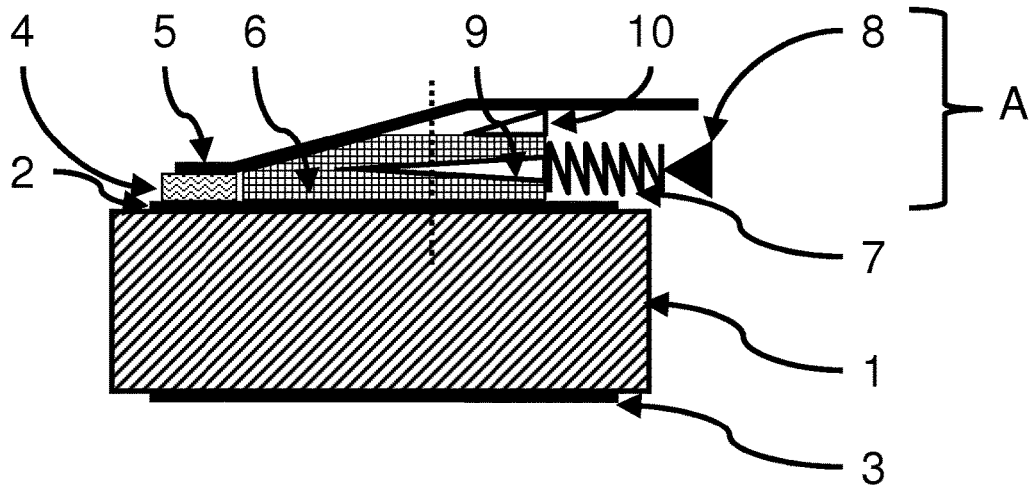
FIG. 3 shows a schematic sectional representation of a third embodiment of the invention.
Figure 4:
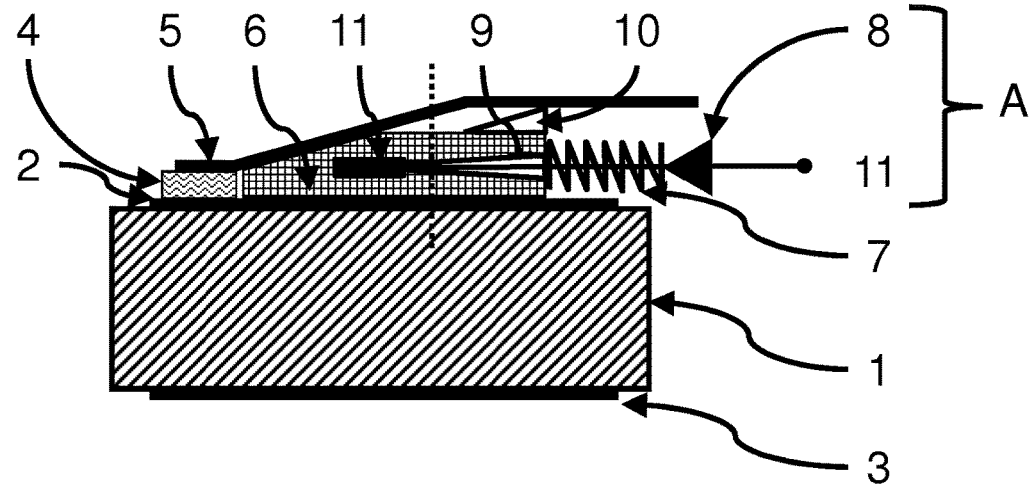
FIG. 4 shows a schematic sectional representation of a fourth embodiment of the invention.
Figure 5:
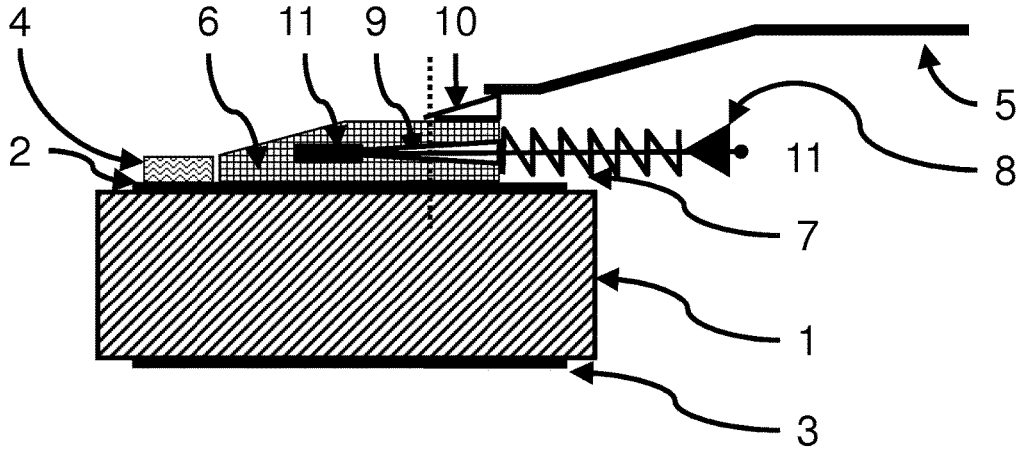
FIG. 5 shows a schematic sectional representation of the fourth embodiment of the invention in a tripped state.

In particular, with an embodiment such as that shown in FIGS. 2 to 5, for example, it can be achieved that the electrical resistance that is exerted on a current flow is dependent on the relative path of the detachment means 6 in relation to the first contact 2 of the varistor 1 and/or the terminal contact 5. Specifically, if the detachment means 6 is inserted further (as shown in FIG. 5, for example), then the current must travel a longer resistive path, across the terminal contact 5 to the first contact 2 via the detachment means 6, instead in a state of immediately disconnection. That is, the resistance can be changed (continuously) using the displacement path, whereby a lower resistance is effectively available at the beginning, for example, so that an electric arc is initially prevented in order for the resistance to be subsequently increased such that the current can be limited to harmless levels.

At the same time, either a wedge-shaped gap 9 can remain as shown in FIGS. 2 to 5, or, alternatively, the (wedge-shaped) gap 9 can be filled out with an appropriately embodied electrically insulating portion. This can be advantageous for achieving improved electrical and/or mechanical characteristics, for example.

That is, the detachment means 6 has a section 9 or several sections 9 that extend in part transversely to the connecting line shown with a broken line in the figures between the contact 2 and the terminal contact 5 and have a lower conductance than other portions of the disconnecting means, so that the electrical resistance of the detachment means 6 changes in accordance with the relative current path.

In embodiments such as those shown in FIGS. 3 to 5, a provision can also be made that the isolating arrester A also has an electrical disconnection means 10 that electrically insulates the terminal contact 5 from the contact 2 of the varistor 1 after a resistively impeded current flow has initially been reached in the event of a fault. That is, in FIG. 5, which shows a tripped state of the isolating arrester A, the flow of current is now no longer possible, since the insulating wedge 10 has now been pushed between the terminal contact 5 and the otherwise resistive detachment means 6.

Without limiting the generality of the invention, the softenable holding device 4 can have an electrically conductive solder or an electrically conductive adhesive.

In an advantageous development, a provision can be made that the detachment means 6 also has an additional electrical contact 11, with the additional electrical contact 11 being arranged such that a voltage divider is made available in relation to the first contact 2 and the terminal contact 5 with the resistive material of the detachment means 6.

Within the detachment means 6, which is arranged so as to be substantially transverse to the direction of current flow, the upper part of the detachment means 6 now forms a first resistance between the additional electrical contact 11 and the terminal contact 5 and a second resistance between the first contact 2 and the additional electrical contact 11. A voltage divider is thus available at the additional electrical contact 11, so that (e.g., after tripping in the event of a fault) a voltage is available at the additional contact 11 that can be used for additional functions such as analysis and signaling. In the embodiment of FIGS. 3 to 5, however, this voltage divider only has relevance until the terminal contact 5 has been disconnected electrically from the contact 2 of the varistor 1 by means of the electrical disconnection means 10. This means that, in this case, the absence of a voltage at the additional electrical contact 11 can be used as a sign of disconnection.

Without limiting the generality of the invention, the resistive behavior of the detachment means 6 can be of a different nature. In particular, besides a linear resistive behavior, it can also have a nonlinear resistive behavior; for example, the detachment means 6 can have a varistor-like characteristic curve or a temperature-dependent characteristic curve—e.g., that of a PTC resistor.

That is, the invention proposes that the energy that is still stored in the network is now released over a defined period of time. For this purpose, the point of separation is not changed abruptly from electrically conductive to highly resistive; instead, the invention allows current to continue flowing for a defined period of time, which can be determined by the time for the displacement of the detachment means 6, but now without the formation of an electric arc.

Through appropriate configuration—e.g., through the use of suitable materials such as resistive plastics, for example—a suitable resistance can also be formed in a surrounding housing or in and by means of internal housing or mechanical fixing components. The necessary electrical contact can also be achieved by molding resistive plastics around voltage-conducting parts.

It is especially advantageous if the resistance between the terminal contact 5 and the first contact 2 changes during disconnection, for example beginning at a low resistance and moving toward a high resistance. This can be achieved, for example, by means of sliding contacts or sliders. In this way, it can be ensured that the ohmic contact acts simultaneously with the opening of the point of separation, thereby ohmically limiting the flowing current. This allows the magnetic energy to be diminished, so that, unlike in conventional devices, a pronounced rise in voltage cannot occur at the point of separation.

Depending on the embodiment, what is made available here is either just a limitation (FIGS. 1 and 2) of the current to a non-hazardous level or a complete disconnection (FIGS. 3 to 5).

Especially advantageously, in the case shown in FIGS. 3 to 5, the resistance and/or the resistance profile can be chosen such that, at the time of disconnection by means of the disconnection means 10, the flow of current has been reduced to the point that disconnection can now be provided without the danger of an electric arc.

By means of the invention, it is thus possible to change the varistor 1 (or also other overvoltage arresters, such as spark gaps or TVS diodes) to a safe state while not endangering the safety and continued operation of a system that is protected by the overvoltage arrester. By virtue of the configuration according to the invention, the time and effort required for designing is reduced while still enabling small construction volumes.

LIST OF REFERENCE SYMBOLS

Varistor 1
First contact 2

Second contact 3
Holding device 4
Terminal contact 5
Detachment means 6
Energy accumulator 7
Energy accumulator contact face 8
Section 9
Electrical disconnection means 10
Additional electrical contact 11
Isolating arrester A

What is claimed is:

1. A varistor with an isolating arrester, wherein the isolating arrester is configured to interrupt the flow of current through the varistor in the event of a fault, wherein the isolating arrester has a terminal contact that establishes an electrical contact to a first contact of the varistor, wherein the electrical contact is protected by a thermally softenable holding device, wherein the isolating arrester also has a detachment means which is biased by means of an energy accumulator and which, in the event of a fault, if the thermally softenable holding device softens, mechanically disconnects the terminal contact from the first contact of the varistor, and wherein the detachment means is resistive in order to limit the current through the varistor and prevent electrical arcs.

2. The varistor as set forth in claim 1, wherein the detachment means achieves the disconnection through mechanical interpositioning and, in doing so, remains in electrical contact with the first contact and/or the terminal contact without interruption.

3. The varistor as set forth in claim 1, wherein the external shape of the detachment means is wedge-like at least in sections.

4. The varistor as set forth in claim 1, wherein the detachment means has plastic and/or ceramic.

5. The varistor as set forth in claim 1, wherein the electrical resistance that is exerted on a current flow is dependent on the relative path of the detachment means in relation to the first contact of the varistor and/or the terminal contact.

6. The varistor as set forth in claim 1, wherein the detachment means has one or more sections that extend in part transversely to the connecting line between the first contact and the terminal contact and have a lower conductance than other portions, so that the electrical resistance of the detachment means changes in accordance with the relative current path.

7. The varistor as set forth in claim 1, wherein the isolating arrester also has an electrical disconnection means that electrically disconnects the terminal contact from the contact of the varistor after a resistively impeded current flow has initially been reached in the event of a fault.

8. The varistor as set forth in claim 1, wherein the softenable holding device has an electrically conductive solder or an electrically conductive adhesive.

9. The varistor as set forth in claim 1, wherein the detachment means also has an additional electrical contact, with the additional electrical contact being arranged such that a voltage divider is made available in relation to the first contact and the terminal contact with the resistive material of the detachment means.

10. The varistor as set forth in claim 1, wherein the detachment means has a nonlinear resistive behavior.

11. A varistor with an isolating arrester, wherein the isolating arrester is configured to interrupt the flow of current through the varistor in the event of a fault, wherein the isolating arrester has a terminal contact that establishes an electrical contact to a first contact of the varistor, wherein the electrical contact is protected by a thermally softenable holding device, wherein the isolating arrester also has a detachment means which is biased by means of an energy accumulator and which, in the event of a fault, if the thermally softenable holding device softens, mechanically disconnects the terminal contact from the first contact of the varistor, wherein the detachment means is resistive in order to limit the current through the varistor and prevent electrical arcs, and wherein the detachment means has a nonlinear resistive behavior.

12. A varistor with an isolating arrester, wherein the isolating arrester is configured to interrupt the flow of current through the varistor in the event of a fault, wherein the isolating arrester has a terminal contact that establishes an electrical contact to a first contact of the varistor, wherein the electrical contact is protected by a thermally softenable holding device, wherein the isolating arrester also has a detachment means which is biased by means of an energy accumulator and which, in the event of a fault, if the thermally softenable, holding device softens, mechanically disconnects the terminal contact from the first contact of the varistor, wherein the detachment means is resistive in order to limit the current through the varistor and prevent electrical arcs, and wherein the electrical resistance that is exerted on a current flow is dependent on the relative path of the detachment means in relation to the first contact of the varistor and/or the terminal contact.

* * * * *